US009041493B2

(12) United States Patent
Ahn et al.

(10) Patent No.: US 9,041,493 B2
(45) Date of Patent: May 26, 2015

(54) COUPLING STRUCTURE FOR MULTI-LAYERED CHIP FILTER, AND MULTI-LAYERED CHIP FILTER WITH THE STRUCTURE

(75) Inventors: Young Ghyu Ahn, Gyeonggi-do (KR); Dong Seok Park, Seoul (KR); Sang Soo Park, Gyeonggi-do (KR); Sung Jin Park, Busan-si (KR); Young Sun Park, Gyeongsangnam-do (KR); Bong Sup Lim, Busan-si (KR)

(73) Assignee: SAMSUNG ELECTRO-MECHANICS CO., LTD., Gyeonggi-Do (KR)

( * ) Notice: Subject to any disclaimer, the term of this patent is extended or adjusted under 35 U.S.C. 154(b) by 466 days.

(21) Appl. No.: 13/109,647

(22) Filed: May 17, 2011

(65) Prior Publication Data

US 2012/0092090 A1 Apr. 19, 2012

(30) Foreign Application Priority Data

Oct. 14, 2010 (KR) ..... 10-2010-01000326

(51) Int. Cl.
*H01P 1/203* (2006.01)
*H01P 5/02* (2006.01)

(52) U.S. Cl.
CPC ..... *H01P 1/20345* (2013.01); *H01P 5/02* (2013.01)

(58) Field of Classification Search
USPC ..... 333/204, 219, 202
See application file for complete search history.

(56) References Cited

U.S. PATENT DOCUMENTS 5,576,672 A * 11/1996 Hirai et al. ..... 333/204
6,812,813 B2 * 11/2004 Mizoguchi et al. ..... 333/204
8,031,035 B2 * 10/2011 Chernyakov et al. ..... 333/203
2008/0116998 A1 * 5/2008 Sekine et al. ..... 333/185
2008/0180192 A1 * 7/2008 Sakisaka et al. ..... 333/185
2010/0164651 A1 * 7/2010 Erb ..... 333/204
2010/0265015 A1 * 10/2010 Hoeft et al. ..... 333/219.1

FOREIGN PATENT DOCUMENTS

JP 06120703 A 4/1994
JP 07-142902 A 6/1995
JP 11266103 A 9/1999
JP 11284408 A 10/1999
JP 2003179404 A 6/2003
JP 2003324301 A 11/2003
JP 2004-159305 A 6/2004
JP 2005-159512 A 6/2005
JP 2006101500 A 4/2006
JP 2007325047 A 12/2007
JP 2009147907 A 7/2009

OTHER PUBLICATIONS

Office Action issued on Oct. 30, 2012 by the Japanese Patent Office in corresponding Japanese Application No. 2011-096835.
KR Office Action for 1020100100326 dated Sep. 14, 2011.

* cited by examiner

*Primary Examiner* — Stephen E Jones
*Assistant Examiner* — Scott S Outten
(74) *Attorney, Agent, or Firm* — Lowe Hauptman & Ham LLP

(57) ABSTRACT

A coupling structure for a multi-layered chip filter includes a resonator layer including a resonator pattern with spaced areas and a coupling layer including at least two separated overlap portion patterns overlapped with the spaced areas of the resonator pattern respectively and a connecting portion pattern having multiple linear portions connecting the separated overlap portion patterns in an area not-overlapped with the resonator pattern.

10 Claims, 6 Drawing Sheets

COUPLING STRUCTURE FOR MULTI-LAYERED CHIP FILTER, AND MULTI-LAYERED CHIP FILTER WITH THE STRUCTURE

CROSS REFERENCE(S) TO RELATED APPLICATIONS

This application claims the benefit under 35 U.S.C. Section 119 of Korean Patent Application Serial No. 10-2010-0100326, entitled "Coupling Structure for Multi-layered Chip Filter and Multi-layered Chip Filter with the Structure" filed on Oct. 14, 2010, which is hereby incorporated by reference in its entirety into this application.

BACKGROUND OF THE INVENTION

1. Technical Field

The present invention relates to a coupling structure for a multi-layered chip filter and a multi-layered chip filter with the structure.

2. Description of the Related Art

Recently, as a mobile communication terminal and a wireless communication device are rapidly increased, a low temperature co-fired ceramic (LTCC) chip filter excellent in view of performance, size, reliability, cost, and the like, has been widely used together with a surface acoustic wave (SAW) filter as a band pass filter (BPF), which is a necessary component for the mobile communication terminal and the wireless communication device.

Generally, LTCC indicates a process technology in which a metal and a ceramic substrate thereof are co-fired at a low temperature and a resultant product thereof. A high-temperature firing method through dielectric ceramic according to the related art should use a high-cost metal such as Pt, Pd, and the like, in view of characteristics thereof. However, this metal has a disadvantage in that it has a large transmission loss in addition to cost side.

However, when using a glass-based material or a ceramic in a form mixed with the glass-based material, substrates coated with a metal may be compressed and fired at about 800 to 1000° C. and also has excellent high-frequency characteristics.

The LTCC method may be used to configure a thin-film multi-layer circuit and in particular, is advantageous in implementing an element having a large size such as an inductor. For example, it is difficult to dispose the inductor over a chip die such an MMIC, a RFIC, or the like, due to its large size. However, when the LTCC method is used, it is possible to dispose the inductor under the chip and also dispose elements to be disposed outside under the chip in a thin film form, thereby making it possible to save a space.

It is possible to fabricate internal elements integrated in the MMIC/RFIC as described above as well as general multi-layered unit passive elements such as C, L, and the like, or fabricate passive elements such as a chip coupler by using the LTCC process.

Generally, a structure of a multi-layered filter configured as a multi-layer through the LTCC process, and the like is configured to include resonator layers 20 and 40, a coupling layer 30 and a ground layer 10 as shown in FIG. 1A. A basic equivalent circuit of the structure shown in FIG. 1A is shown in FIG. 1B.

Meanwhile, in order to improve skirt characteristics or attenuation characteristics through adjustment of an attenuation pole, the multi-layered filter having a coupling inserted between resonators or between input and output ends is widely used, as shown in FIG. 1.

FIG. 2 shows a change in frequency characteristics of a filter due to use of a coupling 31 through a high-frequency three dimensional simulation. It may be appreciated in FIG. 2 that the skirt characteristics and the attenuation characteristics are improved, the attenuation pole is moved to a low frequency, a pass bandwidth becomes narrow, and the phenomena as described above are intensified as an overlap area between the coupling 31 and resonator 41 becomes large.

However, improvement of the attenuation characteristics and movement of the attenuation pole may be limited due to reduction of the pass bandwidth according to increase of the coupling area.

SUMMARY OF THE INVENTION

An object of the present invention is to provide a coupling structure for a multi-layered chip filter capable of overcoming a limitation of an existing coupling by improving a coupling structure and a multi-layered chip filter with the structure.

A coupling structure for a multi-layered chip filter and a multi-layered chip filter with the structure according to an exemplary embodiment have been proposed in consideration of the main object as described above, without being necessarily limited thereto. It should be noted that a description of the specific object does not excludes new objects and effects generated or expected from a configuration according to the present invention described below.

According to an exemplary embodiment of the present invention, there is provided a coupling structure for a multi-layered chip filter based on making a length of a coupling long while equally maintaining a general overlap area between the coupling and a resonator pattern.

The coupling structure for a multi-layered chip filter may include: at least two overlap portion patterns each overlapped with a pattern formed on a resonator layer stacked therewith to form at least two overlap areas spaced from each other; and a connecting portion pattern formed by connecting at least three linear lines having a predetermined length to each other to connect the at least two overlap portion patterns to each other.

The at least three linear lines may be connected while being orthogonal to each other.

Each of the at least two overlap portion patterns may be formed to be spaced from each other in a symmetrical structure.

The connecting portion pattern of the coupling structure may be formed in a symmetrical shape based on a longitudinal axis defined to penetrate through a center between the at least two overlap portion patterns.

The connecting portion pattern of the coupling structure may be formed in a symmetrical shape based on a transversal axis defined to penetrate through the at least two overlap portion patterns.

The connecting portion pattern of the coupling structure may be formed in an asymmetrical shape.

The at least two overlap portion patterns may have the same width as that of the connecting portion pattern. Alternatively, the at least two overlap portion patterns may have a width larger than that of the connecting portion pattern.

The pattern formed on the resonator layer may be configured of two portions spaced from each other, each of the two spaced portions being overlapped with each of the at least two overlap portion patterns.

Two portions of the pattern formed on the resonator layer may be extendedly formed in a longitudinal direction defined to penetrate through a center between the at least two overlap portion patterns. Alternatively, two portions of the pattern formed on the resonator layer may be extendedly formed in a transversal direction defined to penetrate through the at least two overlap portion patterns.

According to another embodiment of the present invention, there is provided a coupling structure for a multi-layered chip filter, including: a coupling overlapped with each of two portions configuring a resonator pattern formed on a resonator layer stacked therewith and separated from each other to form overlap areas, wherein the coupling is formed by connecting at least three linear lines having a predetermined length while being orthogonal to each other.

According to another embodiment of the present invention, there is provided a multi-layered chip filter, including: a first resonator layer; a second resonator layer; a coupling layer between the first resonator layer and the second resonator layer; and a ground layer, wherein a coupling formed in the coupling layer is configured in a coupling structure as described above.

DESCRIPTION OF THE PREFERRED EMBODIMENTS

Hereinafter, exemplary embodiments of the present invention will be described in detail with reference to the accompanying drawings so that those skilled in the art may easily practice the present invention.

Coupling Structure

As describe above, in the multi-layered chip filter, increase of the coupling area causes the pass bandwidth to be reduced, thereby limiting improvement of the attenuation characteristics and movement of the attenuation pole. In order to additionally improve the attenuation characteristics and move the attenuation pole, a coupling structure as shown in FIG. 3 has been suggested.

That is, an improved coupling structure according to an exemplary embodiment of the present invention is configured to have a long length while equally maintaining a general overlap area between a coupling and a resonator pattern as in the related art, if possible, thereby making it possible to prevent a reduction phenomenon of the pass bandwidth, improve the attenuation characteristics, and move the attenuation pole.

In order to accomplish this technical effect, a coupling structure 31 according to an exemplary embodiment of the present invention is mainly configured of at least two overlap portion patterns 31*a* (the overlap portion means a portion overlapped with a resonator pattern) and a connecting portion pattern 31*b* (the connecting portion means a remaining line portion except a portion overlapped with the resonator) connecting a plurality of overlap portion patterns 31*a* to each other, as shown in FIG. 3.

Figure 1A:
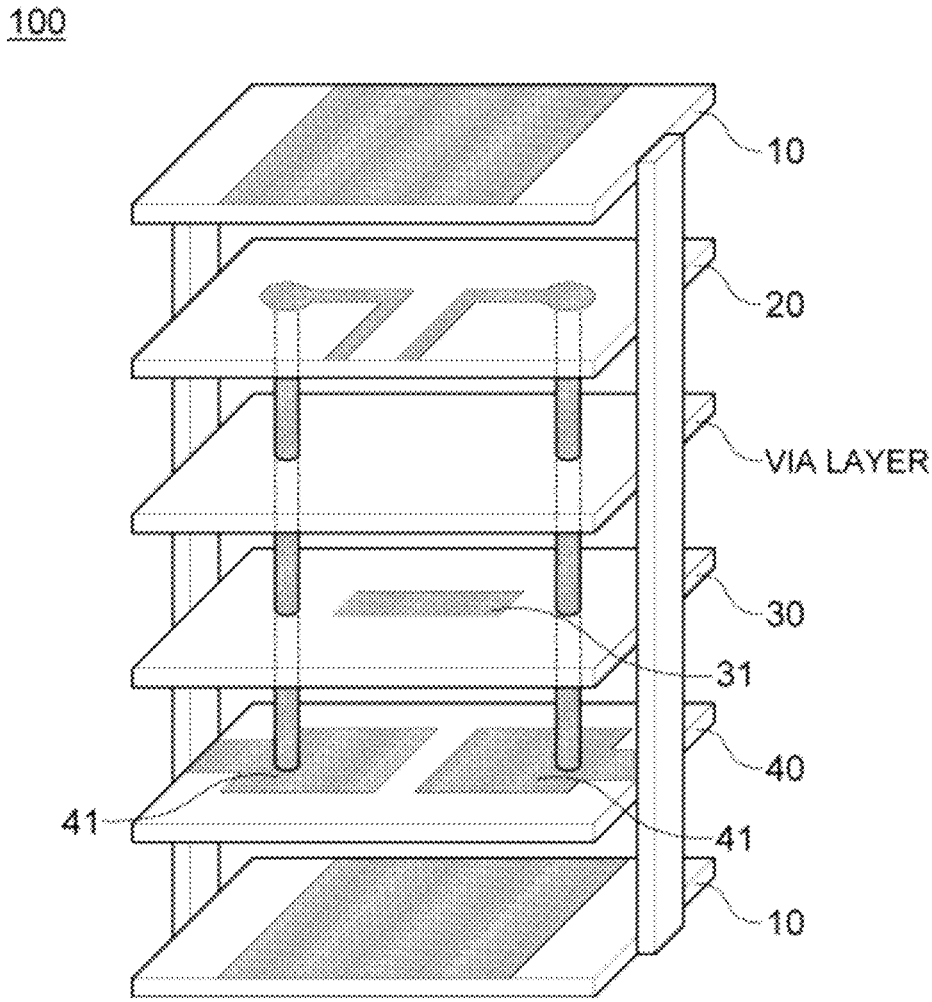
FIG. 1A is a view showing a general structure of a multi-layered chip filter and FIG. 1B is a view showing an equivalent circuit of the structure.
Figure 1B:
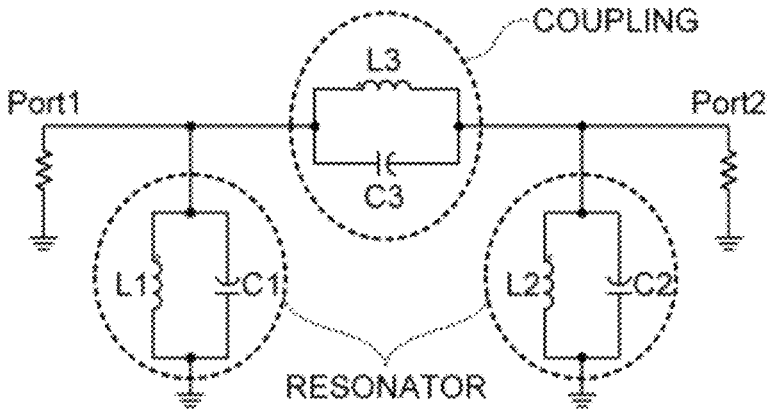
Figure 2:
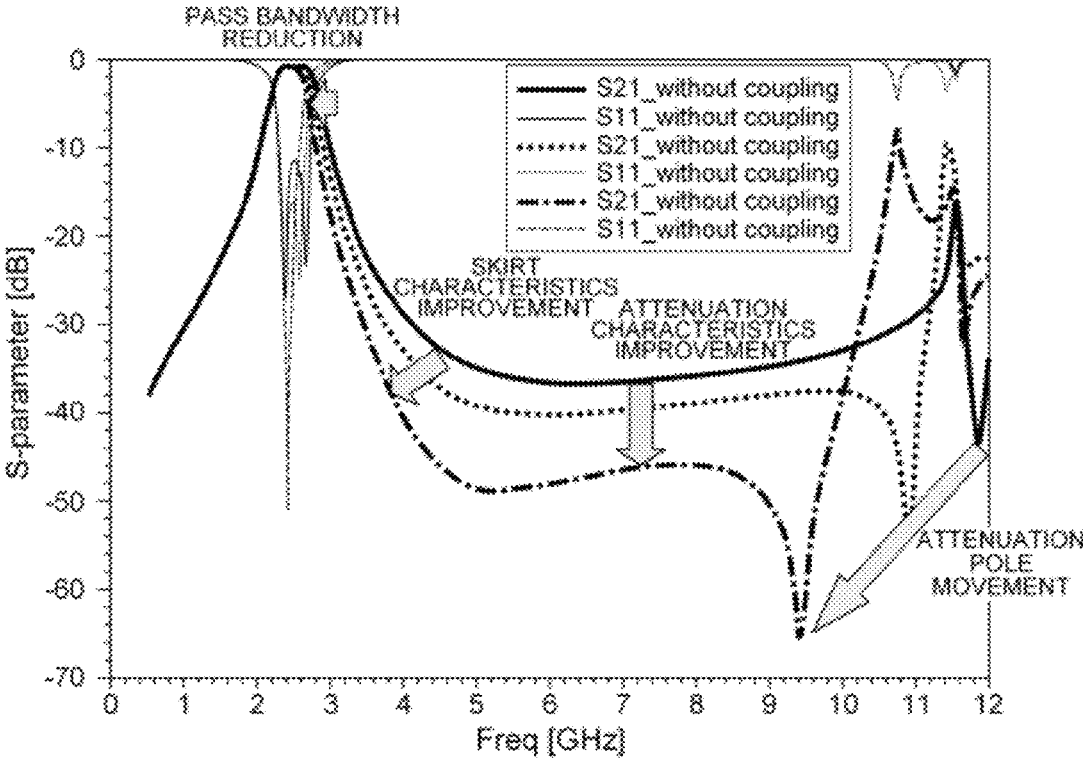
FIG. 2 is a graph showing a change in frequency characteristics according to a coupling area of the multi-layered chip filter.
Figure 3A:
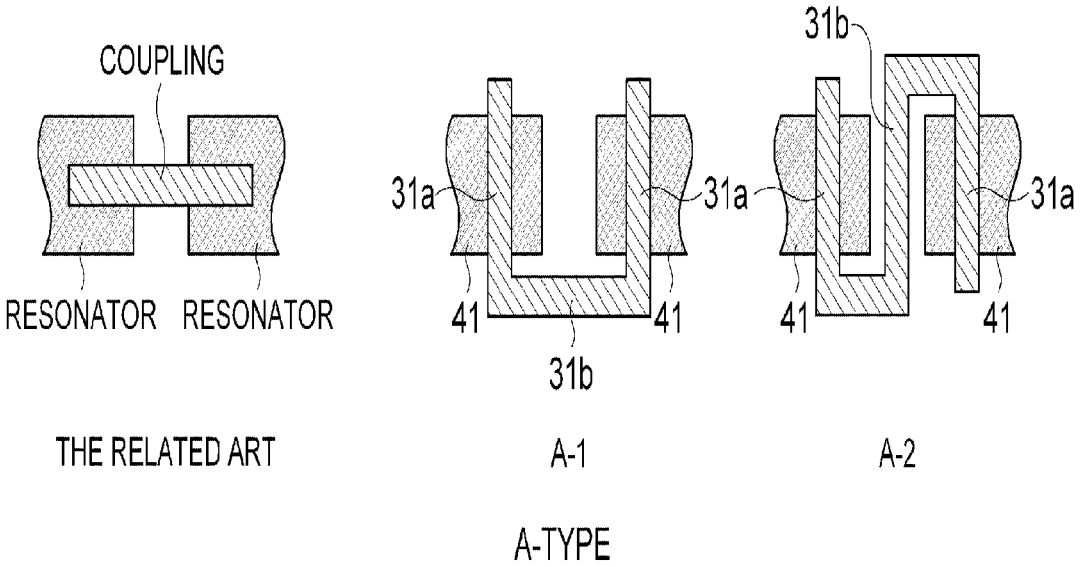
FIG. 3 is a view comparing a coupling structure for a multi-layered chip filter according to an exemplary embodiment of the present invention with a coupling structure according to the related art.
Figure 3B:
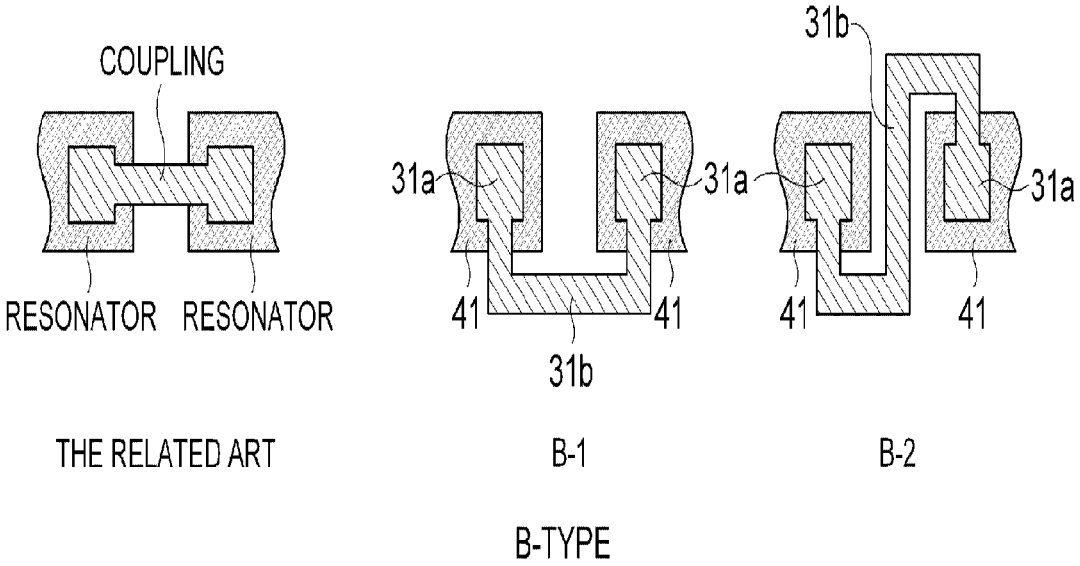

FIG. 3 is a view comparing a coupling (31) structure for a multi-layered chip filter according to an exemplary embodiment of the present invention with a coupling structure according to the related art. As shown in FIGS. 3A and 3B, the coupling (31) structure may be divided into two type, that is, an A type and a B type. While the overlap portion patterns 31*a* and the connecting portion pattern 31*b* of the coupling 31 structure are formed in an integral line shape having the same width rather than being connected to each other in a separate other figure in the A type shown in FIG. 3A, the overlap portion patterns 31*a* of the coupling 31 structure are generally formed in a different figure from that of the connecting portion pattern 31*b*, for example, a shape connected to each other using the connecting portion pattern 31*b* formed in a line having a smaller width than that of the overlap portion patterns 31*a* in a square ("■" and "■") shape in the B type shown in FIG. 3B.

It should be noted that the connecting portion patter 31*b* of the coupling 31 according to the exemplary embodiment of the present invention is configured of at least three linear lines having a predetermined length to connect at least two overlap portion patterns 31*a* to each other. It may be appreciated that three linear lines are connected to form the connecting portion pattern 31*b* in the case of an 'A-1' in FIG. 3A and five linear lines are connected to form the connecting portion pattern 31*b* in the case of an 'A-2' in FIG. 3A. When both cases are compared with the corresponding related art, the whole length of the coupling is increased while substantially equally or similarly maintaining the overlap area between the coupling 31 and the resonator.

That is, as can be seen in FIG. 3, the present invention is configured so that length of the coupling 31 becomes longer while equally maintaining a general overlap area between the coupling 31 and the resonator pattern 41 as in the related art, if possible, thereby making it possible to prevent a reduction phenomenon of the pass bandwidth, improve the attenuation characteristics, and move the attenuation pole.

Figure 4:
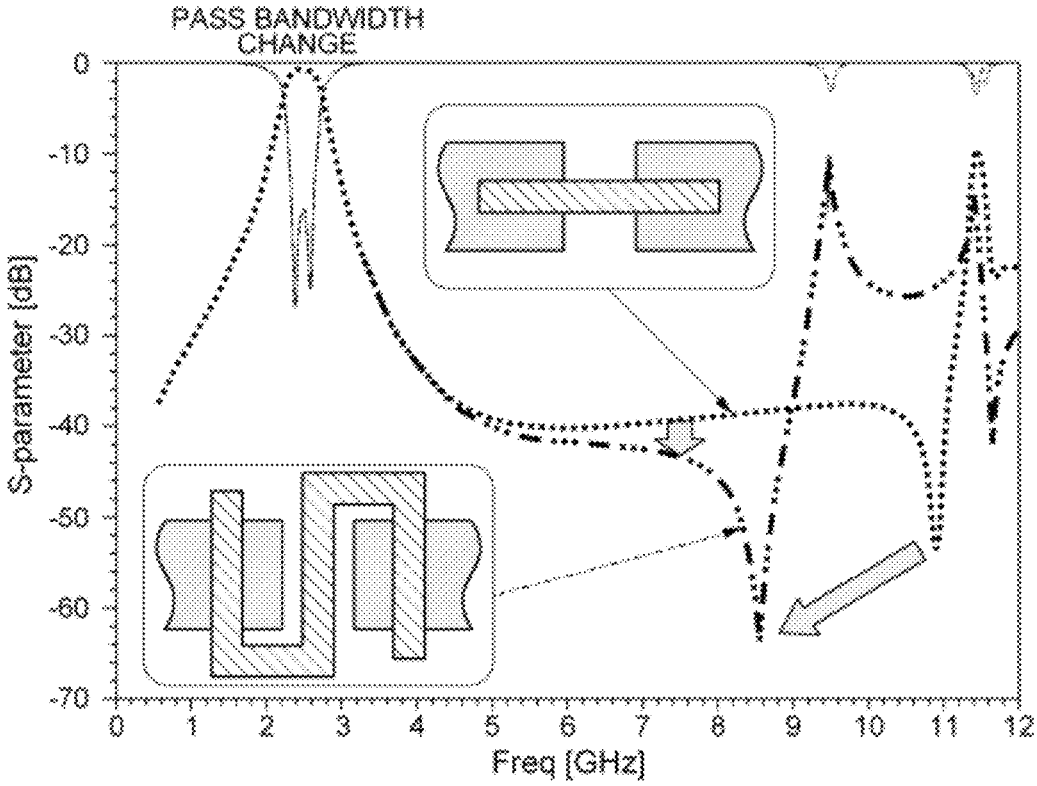
FIG. 4 is a graph comparing frequency characteristics of a filter having the coupling structure according to an exemplary embodiment of the present invention with those of a filter having the coupling structure according to the related art, in FIG. 3.

FIG. 4 is a graph comparing the results of three-dimensional simulation of frequency characteristics of a multi-layered chip filter according to a difference between an 'A-2' type of coupling (31) structure in FIG. 3A and a corresponding structure according to the related art.

As can be seen in the graph shown in FIG. 4, it may be appreciated that the attenuation pole is moved and the attenuation characteristics are improved without change of the pass bandwidth through use of the improved coupling structure.

Meanwhile, the A type of coupling 31 in FIG. 3A is configured only of linear (connecting) lines overlapped with each of two portions configuring resonator patterns 41 formed on the resonator layer and separated from each other to form the overlap area. At least three of linear lines are required for configuring the coupling 31 and may be represented to be orthogonally connected to each other.

In particular, in the case of the coupling (31) structure such as the A type in FIG. 3A, although alignment is somewhat misaligned in all directions in a stacking process, the overlap area between the resonator pattern and the coupling 31 pattern may be always constantly maintained. Therefore, the coupling structure may be a structure enduring various fluctuations in a process.

Various Other Embodiments Related to Coupling Structure

Figure 5:
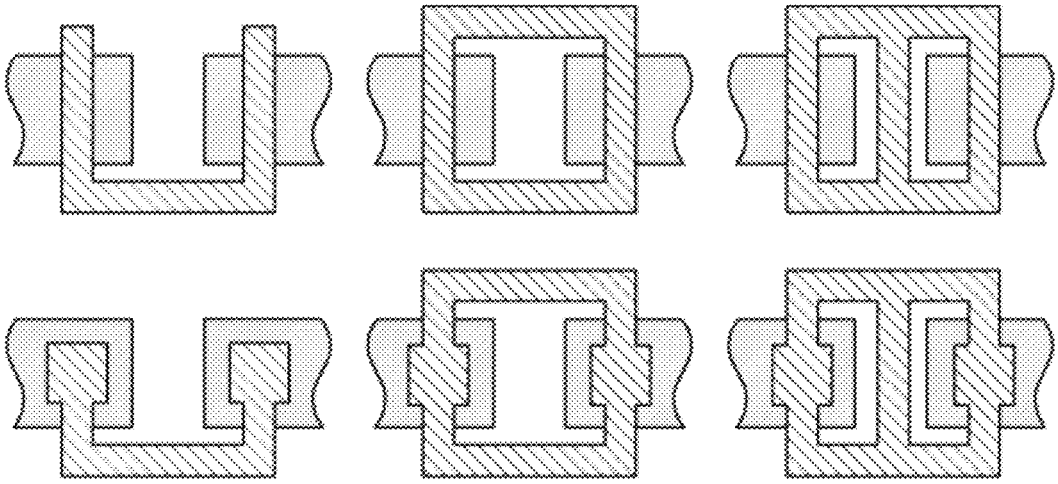
FIGS. 5 to 7 are views showing various modified examples of a coupling structure for a multi-layered chip filter of the present invention according to an arrangement of a resonator pattern.
Figure 6:
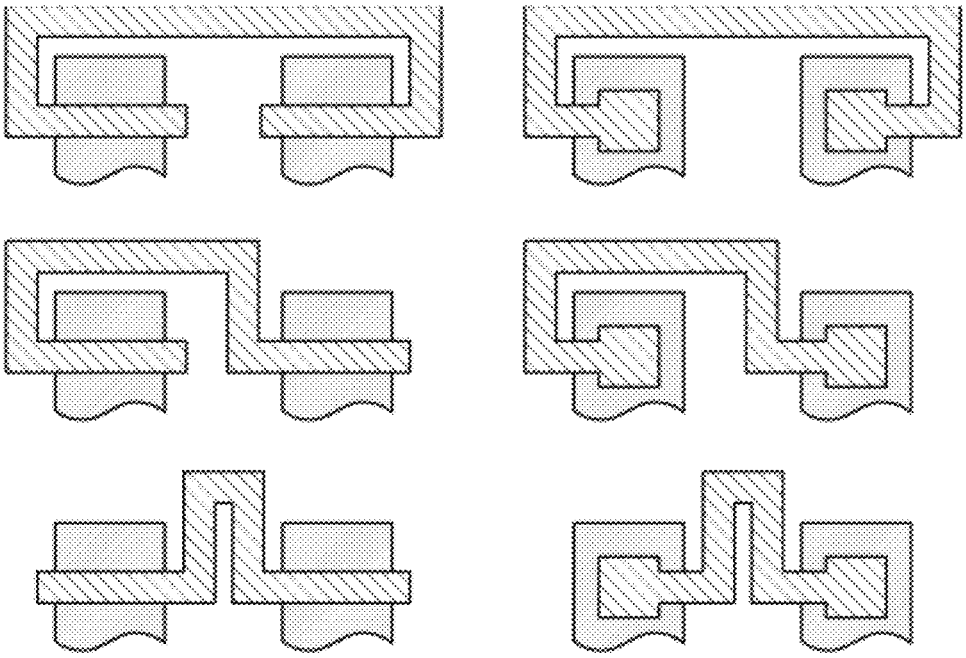
Figure 7:
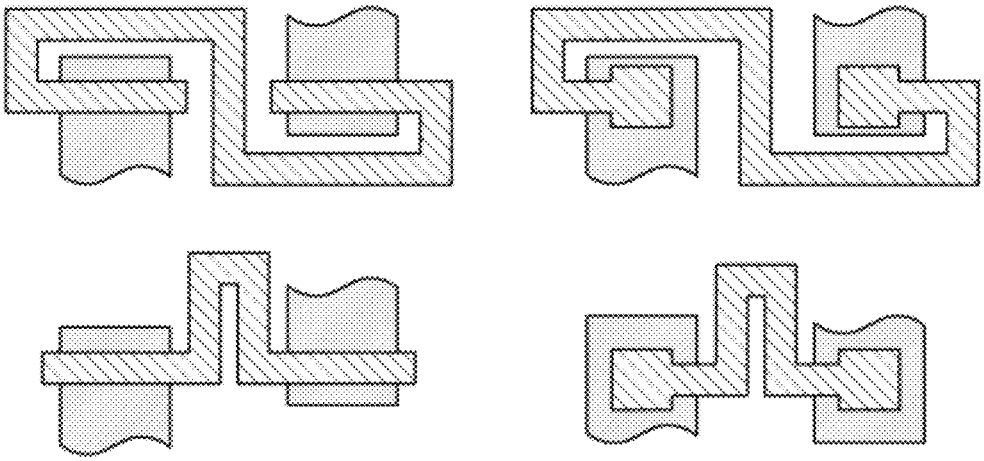

The embodiment in FIG. 3 as described above may be implemented as various modified example as in FIGS. 5 to 7 according to a structure of a resonator.

FIGS. 5 to 7 are views showing various modified examples of a coupling 31 structure for a multi-layered chip filter of the present invention according to an arrangement of a resonator pattern.

FIG. 5 shows a possible structure of a coupling 31 in the case in which resonator patterns 41 formed on a resonator layer is divided into two parts in serial with each other and is extendedly formed in a transversal direction.

FIG. 6 shows a possible structure of a coupling 31 in the case in which resonator patterns 41 formed on a resonator layer is divided into two parts in parallel with each other and is extendedly formed in a longitudinal direction.

FIG. 7 shows a possible structure of a coupling 31 in the case in which resonator patterns 41 formed on a resonator layer is divided into two parts in parallel with each other, is extended in a longitudinal direction, and is disposed in a zigzag shape to each other, as in FIG. 6.

When collectively considering embodiments shown in FIGS. 5 to 7, while at least three linear lines are preferably connected while being orthogonal to each other, the present invention is not necessarily limited to the linear lines. Therefore, the present invention may also include a curved line as possible modified examples thereof within a scope generating the same or similar effect.

As can be seen in FIGS. 5 to 7, the connecting portion pattern 31*b* of the coupling 31 may be formed in a symmetrical shape based on a longitudinal axis defined to penetrate through a center between two overlap portion patterns 31*a*. Additionally or alternatively, the connecting portion pattern 31*b* of the coupling 31 may be also formed in a symmetrical shape based on a transversal axis defined to penetrate through two overlap portion patterns 31*a*.

Although alignment is somewhat misaligned in all directions in a stacking process, the symmetrical structure of the coupling 31 pattern may substantially constantly maintain the overlap area between the resonator 41 pattern and the coupling 31 pattern. Therefore, the symmetrical structure of the coupling 31 pattern may be a structure enduring various fluctuations in a process as compared to other asymmetrical structure.

Furthermore, as shown as partially modified examples FIG. 6, the connecting portion pattern 31*b* may be also formed in an asymmetrical shape, if necessary.

Although the possible modified examples of the coupling 31 pattern according to the exemplary embodiment of the present invention have been shown in FIGS. 5 to 7, the present invention is not necessarily limited to these examples. Therefore, it is obvious that embodiments for the connecting portion pattern 31*b* of the coupling 31 partially bypassing two overlap portions of the coupling 31 overlapped with the resonator pattern 41, without connecting the two overlap portions to each other in a direct line, which is a shortest distance, are basically within a technical scope of the prevent invention.

Multi-Layered Chip Filter Structure with the Coupling Structure

A geometrical shape of the coupling 31 implemented in a coupling layer 30 of a multi-layered chip filter 100 has been described above.

Figure 8:
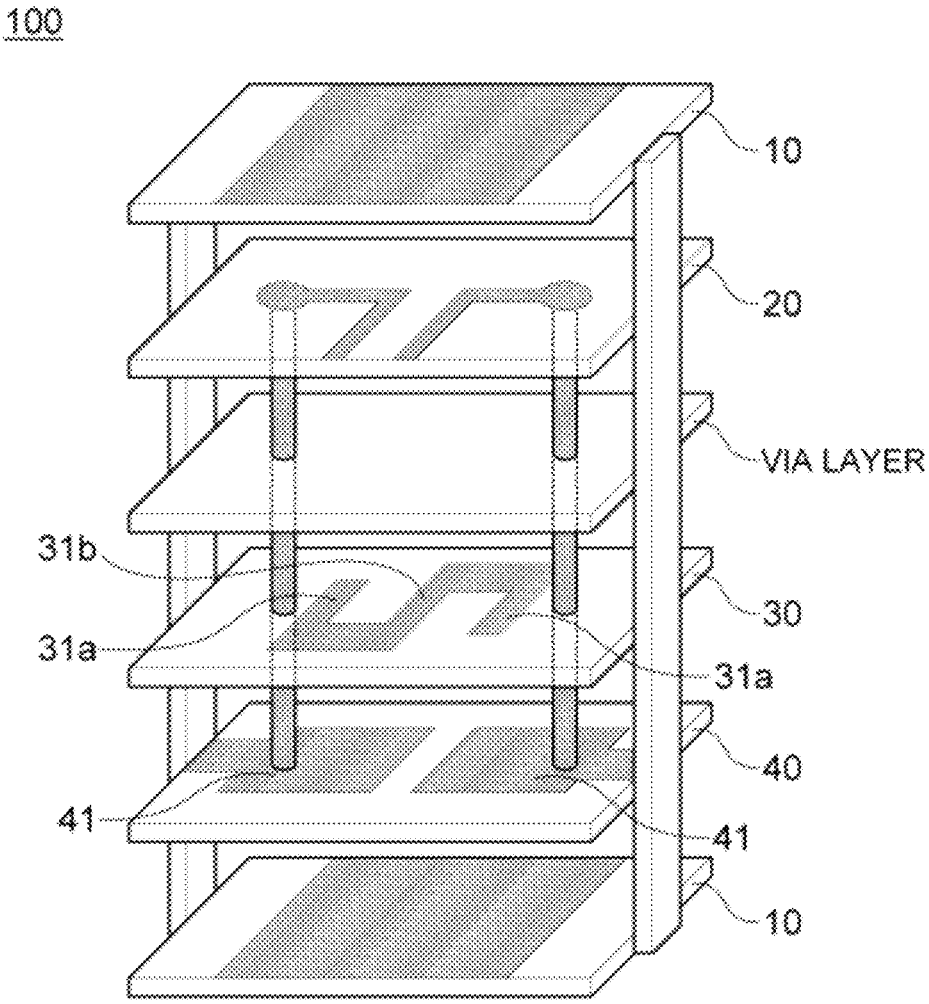
FIG. 8 is a view showing a multi-layered chip filter including a coupling structure according to an exemplary embodiment of the present invention.

A multi-layered chip filter 100 including the coupling 31 structure is shown in FIG. 8.

As shown in FIG. 8, a multi-layered chip filter 100 according to an exemplary embodiment of the present invention is mainly configured to include a first resonator layer 20, a second resonator layer 40, a coupling layer 30 stacked between the first and second resonator layers 40, and a ground layer 10.

For example, a pattern formed on the first resonator layer may be an inductor and a pattern formed in the second resonator layer may be a capacitor.

The coupling 31 patterned in the coupling layer 30 is basically configured of two left and right overlap portion patterns 31*a* each forming overlap areas of resonator patterns 41 in the second resonator layer 40 and a connecting portion pattern 31*b* connecting the two left and right overlap portion patterns 31*a* to each other. The connecting portion pattern 31*b* is configured of at least three linear lines having a predetermined length.

The various embodiments above-mentioned for the coupling 31 structure formed in the coupling layer 30 may be applied to the multi-layered chip filter according to the present invention. Therefore, the overlapping description thereof will be omitted.

Since the exemplary embodiments of the present invention have been described, those skilled in the art should appreciate that that various modifications and equivalent other embodiments may be made. Therefore, it is to be understood that the invention is not limited to the disclosed embodiments, but, on the contrary, is intended to cover various modifications and equivalent arrangements included within the spirit and scope of the appended claims.

What is claimed is:

1. A coupling structure for a multi-layered chip filter, the coupling structure comprising:

a resonator layer including a resonator pattern with spaced areas; and a coupling layer electrically connected to the resonator layer and including thereon at least two separated overlap portion patterns overlapped with the spaced areas of the resonator pattern, respectively, and a connecting portion pattern formed in a symmetrical shape based on a transversal axis defined to penetrate through the separated overlap portion patterns, the connecting portion pattern having multiple linear portions connecting the separated overlap portion patterns in an area not-overlapped with the resonator pattern, wherein the connecting portion pattern is formed with multiple linear lines connected and bent according to the edge of the resonator pattern.

2. The coupling structure according to claim 1, wherein the resonator pattern is configured to have two portions.

3. The coupling structure according to claim 2, wherein the resonator pattern is extendedly formed in a longitudinal direction defined to penetrate through a center between the overlap portion patterns.

4. The coupling structure according to claim 2, wherein the resonator pattern is extendedly formed in a transversal direction defined to penetrate through the overlap portion patterns.

5. The coupling structure according to claim 1, wherein the multiple linear portions are each connected at a 90 degree angle.

6. The coupling structure according to claim 1, wherein the separated overlap portion patterns are in a symmetrical structure.

7. The coupling structure according to claim 1, wherein the overlap portion patterns have the same width as that of the connecting portion pattern.

8. The coupling structure according to claim 1, wherein the overlap portion patterns have a width larger than that of the connecting portion pattern.

9. A multi-layered chip filter, comprising:

a first resonator layer;

a second resonator layer;

a coupling layer between the first resonator layer and the second resonator layer; and a ground layer, wherein a coupling pattern formed in the coupling layer is configured in a coupling structure according to claim 1.

10. A coupling structure for a multi-layered chip filter, the coupling structure comprising:

a resonator layer including resonator patterns that, when viewed from above the resonator layer, include a space between the resonator patterns, and top and bottom spaces above and below the resonator patterns, respectively; and a coupling layer electrically connected to the resonator layer and including thereon at least two separated overlap portion patterns overlapped with the resonator patterns, respectively, and a connecting portion pattern having multiple linear portions connecting the separated overlap portion patterns in an area not-overlapped with the resonator patterns, wherein the multiple linear portions are arranged in both a first region corresponding to the top space of the resonator layer, and a second region corresponding to the bottom space of the resonator layer, and in a third region corresponding to the space between the resonator patterns.

* * * * *